US011048189B2

(12) United States Patent
Adachi et al.

(10) Patent No.: US 11,048,189 B2
(45) Date of Patent: Jun. 29, 2021

(54) TONER CONTAINER, TONER SUPPLY DEVICE, AND IMAGE FORMING APPARATUS INCLUDING A SHEET MEMBER WITH TWO PORTIONS TO MOVE TONER

(71) Applicants: Takahiro Adachi, Kanagawa (JP); Koichi Yamazaki, Kanagawa (JP); Hideo Yoshizawa, Kanagawa (JP); Tatsuya Ohhira, Kanagawa (JP)

(72) Inventors: Takahiro Adachi, Kanagawa (JP); Koichi Yamazaki, Kanagawa (JP); Hideo Yoshizawa, Kanagawa (JP); Tatsuya Ohhira, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/799,833

(22) Filed: Feb. 25, 2020

(65) Prior Publication Data

US 2020/0292963 A1 Sep. 17, 2020

(30) Foreign Application Priority Data

Mar. 13, 2019 (JP) ..... JP2019-045487
Sep. 17, 2019 (JP) ..... JP2019-168053

(51) Int. Cl.
*G03G 15/08* (2006.01)

(52) U.S. Cl.
CPC ..... *G03G 15/0886* (2013.01); *G03G 15/0889* (2013.01)

(58) Field of Classification Search
USPC ..... 399/260
See application file for complete search history.

(56) References Cited

U.S. PATENT DOCUMENTS 5,909,610 A * 6/1999 Yoshiki ..... G03G 15/0868 399/262
6,405,010 B2 * 6/2002 Ashikari ..... G03G 15/0875 399/256

(Continued)

FOREIGN PATENT DOCUMENTS

EP 0813121 A1 12/1997
JP 2006-071762 3/2006

(Continued)

OTHER PUBLICATIONS

Extended European Search Report dated Aug. 14, 2020, issued in corresponding European Patent Application No. 20160822.1, 7 pages.

*Primary Examiner* — Q Grainger
(74) *Attorney, Agent, or Firm* — Xsensus LLP

(57) ABSTRACT

A toner container includes a cylindrical container body having a head with an opening in the head, a cap into which the head of the container body is inserted, and a sheet member attached inside the cap. The cylindrical container body rotates around a rotation axis extending in a longitudinal direction of the container body to transport toner contained in the container body toward the opening. The cap has a toner outlet through which the toner discharged from the opening is discharged outside the toner container. The sheet member includes a first elastic-deformation portion that is elastically deformable and located near the toner outlet, and a second elastic-deformation portion that is elastically deformable and located in the container body and near the opening.

13 Claims, 6 Drawing Sheets

(56) References Cited

U.S. PATENT DOCUMENTS

| | | | | |
|---|---|---|---|---|
| 8,989,636 | B2 * | 3/2015 | Hori | G03G 15/0886 399/262 |
| RE47,086 | E | 10/2018 | Taguchi et al. | |
| 2005/0169672 | A1 * | 8/2005 | Ban | G03G 15/0886 399/258 |
| 2006/0034642 | A1 | 2/2006 | Taguchi et al. | |
| 2007/0122205 | A1 | 5/2007 | Taguchi et al. | |
| 2007/0147900 | A1 | 6/2007 | Taguchi et al. | |
| 2007/0147902 | A1 | 6/2007 | Taguchi et al. | |
| 2007/0154243 | A1 | 7/2007 | Taguchi et al. | |
| 2007/0154244 | A1 | 7/2007 | Taguchi et al. | |
| 2007/0160393 | A1 | 7/2007 | Taguchi et al. | |
| 2007/0160394 | A1 | 7/2007 | Taguchi et al. | |
| 2007/0177886 | A1 | 8/2007 | Taguchi et al. | |
| 2008/0124133 | A1 | 5/2008 | Yoshizawa et al. | |
| 2010/0189470 | A1 | 7/2010 | Yoshizawa et al. | |
| 2011/0002713 | A1 | 1/2011 | Taguchi et al. | |
| 2011/0008075 | A1 | 1/2011 | Taguchi et al. | |
| 2011/0058857 | A1 | 3/2011 | Hori et al. | |
| 2011/0081171 | A1 * | 4/2011 | Kimura | G03G 15/0879 399/263 |
| 2011/0286771 | A1 | 11/2011 | Taguchi et al. | |
| 2013/0064577 | A1 | 3/2013 | Hayashi et al. | |
| 2013/0322929 | A1 * | 12/2013 | Kobayashi | G03G 15/0879 399/263 |
| 2014/0064794 | A1 | 3/2014 | Takahashi et al. | |
| 2014/0270859 | A1 * | 9/2014 | Hosokawa | G03G 15/0886 399/262 |
| 2015/0063875 | A1 | 3/2015 | Ohshima et al. | |
| 2016/0004184 | A1 * | 1/2016 | Kikuchi | G03G 15/2028 399/258 |
| 2017/0068184 | A1 | 3/2017 | Kikuchi et al. | |
| 2017/0102638 | A1 | 4/2017 | Yamabe et al. | |
| 2017/0212449 | A1 | 7/2017 | Kuboki et al. | |

FOREIGN PATENT DOCUMENTS

| | | |
|---|---|---|
| JP | 2010-117604 | 5/2010 |
| JP | 2013-061496 | 4/2013 |
| JP | 2013-068716 | 4/2013 |
| JP | 2013-080027 | 5/2013 |
| JP | 2014-048541 | 3/2014 |
| JP | 2014081663 A | 5/2014 |

* cited by examiner

TONER CONTAINER, TONER SUPPLY DEVICE, AND IMAGE FORMING APPARATUS INCLUDING A SHEET MEMBER WITH TWO PORTIONS TO MOVE TONER

CROSS-REFERENCE TO RELATED APPLICATIONS

This patent application is based on and claims priority pursuant to 35 U.S.C. § 119(a) to Japanese Patent Application Nos. 2019-045487, filed on Mar. 13, 2019 and 2019-168053, filed on Sep. 17, 2019, in the Japan Patent Office, the entire disclosure of each of which is hereby incorporated by reference herein.

BACKGROUND

Technical Field

Embodiments of the present disclosure generally relate to a toner container to store toner therein, a toner supply device incorporating the toner container, and an image forming apparatus, such as a copier, a printer, a facsimile machine, or a multifunction peripheral (MFP) having at least two of such capabilities, incorporating the toner supply device.

Description of the Related Art

In image forming apparatuses such as copiers, printers, and the like, a cylindrical toner container (toner bottle) that is removably installable in the image forming apparatus is widely used.

SUMMARY

Embodiments of the present disclosure describe an improved toner container that includes a cylindrical container body having a head with an opening in the head, a cap into which the head of the container body is inserted, and a sheet member attached inside the cap. The cylindrical container body rotates around a rotation axis extending in a longitudinal direction of the container body to transport toner contained in the container body toward the opening. The cap has a toner outlet through which toner discharged from the opening is discharged outside the toner container. The sheet member includes a first elastic-deformation portion that is elastically deformable and located near the toner outlet, and a second elastic-deformation portion that is elastically deformable and located in the container body and near the opening.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
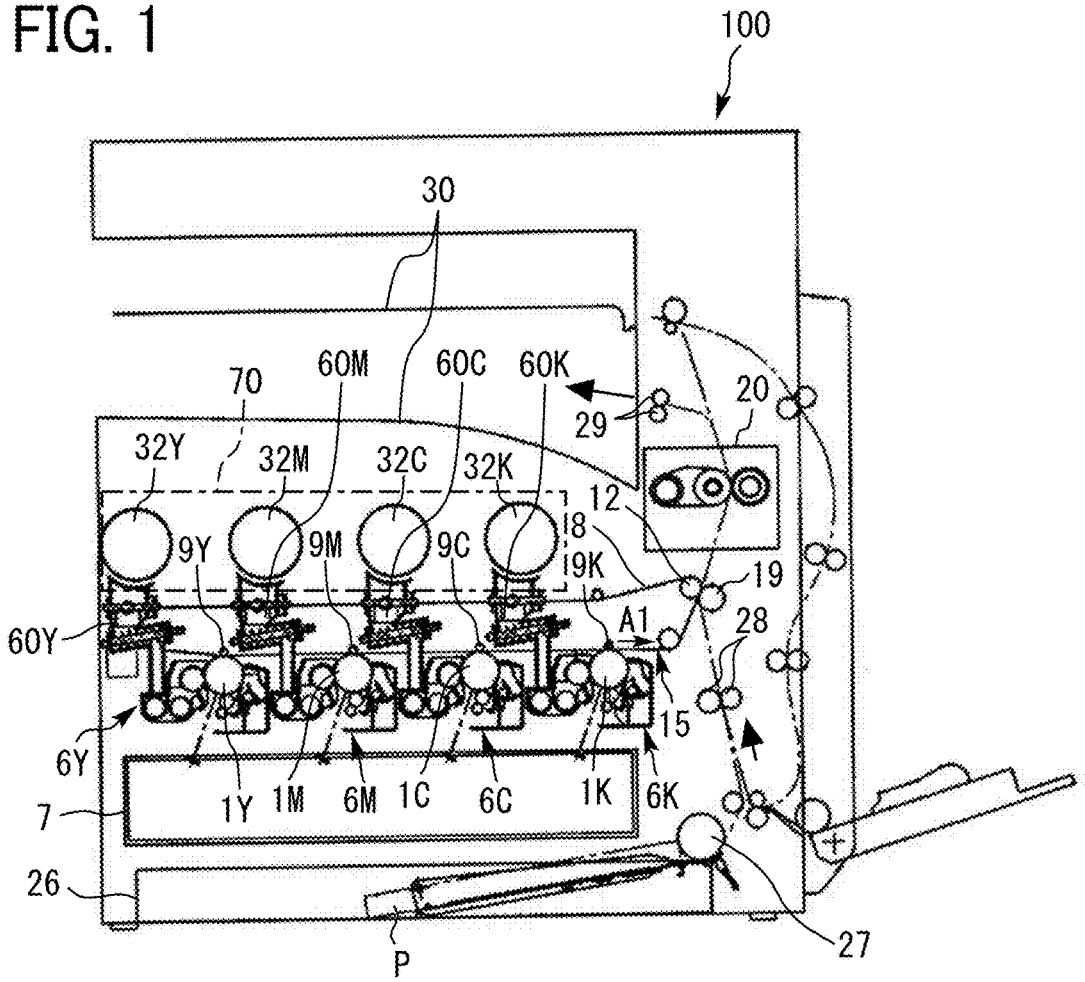
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

Embodiments of the present disclosure are described in detail with reference to drawings. It is to be understood that identical or similar reference numerals are assigned to identical or corresponding components throughout the drawings, and redundant descriptions are omitted or simplified below as required.

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

Configuration and operation of an image forming apparatus 100 according to the present embodiments is described below.

As illustrated in FIG. 1, in an upper part of the image forming apparatus 100, four toner containers 32Y, 32M, 32C, and 32K respectively corresponding to yellow, magenta, cyan, and black are removably installed in a toner container mount 70.

An intermediate transfer unit 15 is disposed below the toner container mount 70. Image forming units 6Y, 6M, 6C, and 6K are arranged side by side, facing an intermediate transfer belt 8 of the intermediate transfer unit 15 to form toner images of yellow, magenta, cyan, and black, respectively.

Toner supply devices 60Y, 60M, 60C, and 60K are disposed below the toner containers 32Y, 32M, 32C, and 32K, respectively. The toner supply devices 60Y, 60M, 60C, and 60K supply toner contained in the toner containers 32Y, 32M, 32C, and 32K to developing devices 5Y, 5M, 5C, and 5K (see FIG. 2) of the image forming units 6Y, 6M, 6C, and 6K, respectively.

Figure 2:
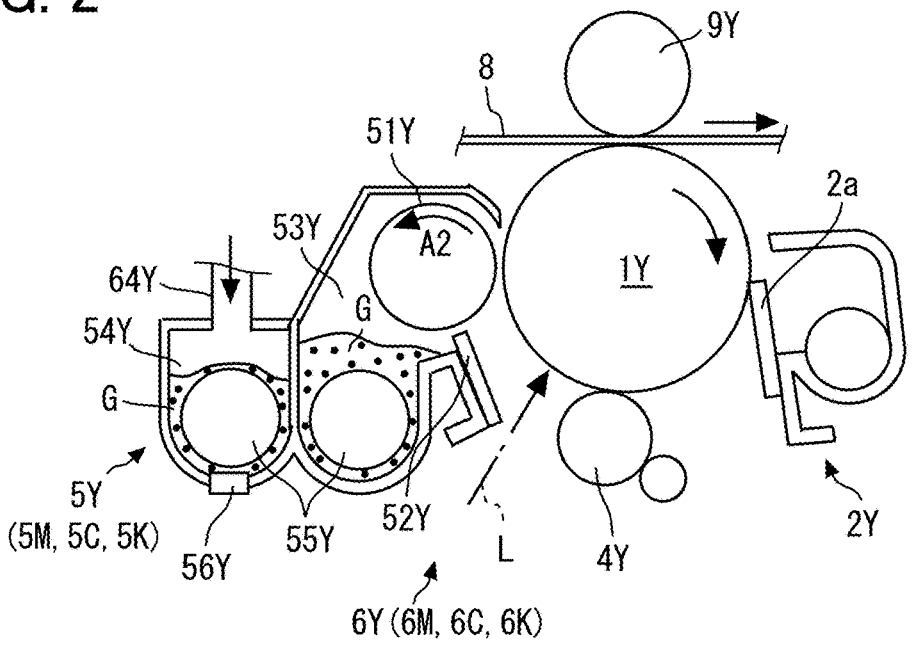
FIG. 2 is a cross-sectional view of an image forming unit of the image forming apparatus in FIG. 1.

With reference to FIG. 2, it can be seen that the image forming unit 6Y for yellow includes a photoconductor drum 1Y and a charging device 4Y, the developing device 5Y, a cleaning device 2Y, a discharge device, and the like disposed around the photoconductor drum 1Y. Image forming processes, namely, charging, exposure, development, transfer, cleaning, and discharging processes, are performed on the photoconductor drum 1Y, and thus a yellow toner image is formed on a surface of the photoconductor drum 1Y.

The other three image forming units 6M, 6C, and 6K have a similar configuration to that of the yellow image forming unit 6Y except for the color of toner used therein and form magenta, cyan, and black toner images, respectively. Thus, only the image forming unit 6Y is described below and descriptions of the other three image forming units 6M, 6C, and 6K are omitted.

With reference to FIG. 2, it can be seen that the photoconductor drum 1Y is rotated clockwise in FIG. 2 by a drive motor. The charging device 4Y uniformly charges a surface of the photoconductor drum 1Y (charging process).

When the surface of the photoconductor drum 1Y reaches a position where the surface of the photoconductor drum 1Y is irradiated with a laser beam L emitted from an exposure device 7 (see FIG. 1), the photoconductor drum 1Y is scanned with the laser beam L, and thus an electrostatic latent image for yellow is formed thereon (exposure process).

Then, the surface of the photoconductor drum 1Y reaches a position opposite the developing device 5Y, where the electrostatic latent image is developed with toner into a yellow toner image (development process).

As the surface of the photoconductor drum 1Y carrying the toner image reaches a position opposite a primary transfer roller 9Y via the intermediate transfer belt 8, the toner image on the photoconductor drum 1Y is transferred onto the intermediate transfer belt 8 (primary transfer process). After the primary transfer process, a certain amount of untransferred toner remains on the photoconductor drum 1Y.

When the surface of the photoconductor drum 1Y reaches a position opposite the cleaning device 2Y, a cleaning blade 2*a* of the cleaning device 2Y mechanically collects the untransferred toner on the photoconductor drum 1Y (cleaning process).

Subsequently, the surface of the photoconductor drum 1Y reaches a position opposite a discharge device, and the discharge device removes any residual electric potential from the photoconductor drum 1Y (discharging process) to complete a sequence of image forming processes performed on the photoconductor drum 1Y.

The above-described image forming processes are performed in the image forming units 6M, 6C, and 6K similarly to the yellow image forming unit 6Y. That is, the exposure device 7 disposed below the image forming units 6M, 6C, and 6K irradiates photoconductor drums 1M, 1C, and 1K of the image forming units 6M, 6C, and 6K with the laser beams L based on image data.

Then, the toner images formed on the photoconductor drums 1Y, 1M, 1C, and 1K through the development process are transferred therefrom and superimposed on the intermediate transfer belt 8. Thus, a multicolor toner image is formed on the intermediate transfer belt 8.

With reference to FIG. 1, it can be seen that the intermediate transfer unit 15 includes the intermediate transfer belt 8, four primary transfer rollers 9Y, 9M, 9C, and 9K, a secondary-transfer backup roller 12, multiple tension rollers, and a belt cleaning device. The intermediate transfer belt 8 is stretched around and supported by the multiple rollers and is rotated in the direction indicated by arrow A1 illustrated in FIG. 1 as one of the multiple rollers that serves as a drive roller rotates (i.e., the secondary-transfer backup roller 12).

The four primary transfer rollers 9Y, 9M, 9C, and 9K are pressed against the corresponding photoconductor drums 1Y, 1M, 1C, and 1K, respectively, via the intermediate transfer belt 8 to form primary transfer nips. A primary-transfer bias opposite in polarity to that of the toner is applied to the primary transfer rollers 9Y, 9M, 9C, and 9K.

While rotating in the direction indicated by arrow A1 in FIG. 1, the intermediate transfer belt 8 passes through the primary transfer nips between the photoconductor drums 1Y, 1M, 1C, and 1K and the respective four primary transfer rollers 9Y, 9M, 9C, and 9K. Then, the single-color toner images on the photoconductor drums 1Y, 1M, 1C, and 1K are primarily transferred to and superimposed on the intermediate transfer belt 8, thereby forming the multicolor image.

Subsequently, the intermediate transfer belt 8 carrying the multicolor toner image reaches a position opposite a secondary transfer roller 19. At this position, the secondary-transfer backup roller 12 and the secondary transfer roller 19 press against each other via the intermediate transfer belt 8, thereby forming a secondary transfer nip. The multicolor toner image on the intermediate transfer belt 8 is transferred onto a sheet P such as a paper sheet transported to the secondary transfer nip (secondary transfer process). At that time, untransferred toner that is not transferred onto the sheet P remains on the surface of the intermediate transfer belt 8.

The surface of the intermediate transfer belt 8 then reaches a position opposite the belt cleaning device, and the untransferred toner is collected from the intermediate transfer belt 8 to complete a series of image transfer processes performed on the intermediate transfer belt 8.

The sheet P is transported from a sheet feeder 26 disposed in a lower portion of the image forming apparatus 100 to the secondary transfer nip via a feed roller 27 and a registration roller pair 28.

Specifically, the sheet feeder 26 contains a stack of multiple sheets P such as paper sheets piled one on another. As the feed roller 27 rotates counterclockwise in FIG. 1, the feed roller 27 feeds a top sheet P from the stack in the sheet feeder 26 to a roller nip between the registration roller pair 28.

The registration roller pair 28 stops rotating temporarily, stopping the sheet P with a leading edge of the sheet P nipped in the registration roller pair 28. Then, the registration roller pair 28 rotates to transport the sheet P to the secondary transfer nip, timed to coincide with the arrival of the multicolor toner image on the intermediate transfer belt 8. Thus, the desired multicolor toner image is transferred onto the sheet P.

Subsequently, the sheet P, onto which the multicolor image is transferred at the secondary transfer nip, is transported to a fixing device 20. In the fixing device 20, a fixing belt and a pressure roller apply heat and pressure to the sheet P to fix the multicolor toner image on the sheet P.

Subsequently, the sheet P is ejected by an output roller pair 29 outside the image forming apparatus 100. The sheets P ejected by the output roller pair 29 are sequentially stacked as output images on a stack tray 30 to complete a sequence of image forming processes performed in the image forming apparatus 100.

Next, a description is provided of the configuration and operation of the developing device 5Y in further detail with reference to FIG. 2.

The developing device 5Y includes a developing roller 51Y disposed opposite the photoconductor drum 1Y, a doctor blade 52Y opposite the developing roller 51Y, two conveying screws 55Y disposed in developer-containing compartments 53Y and 54Y, and a toner concentration sensor 56Y to detect concentration of toner in a developer G. The developing roller 51Y includes stationary magnets therein, a sleeve that rotates around the magnets, and the like. The developer-containing compartments 53Y and 54Y contain the two-component developer G including carrier and toner. The developer-containing compartment 54Y communicates, via an opening on an upper side thereof, with a downward toner passage 64Y.

The developing device 5Y operates as follows.

The sleeve of the developing roller 51Y rotates in the direction indicated by arrow A2 illustrated in FIG. 2. The developer G is carried on the developing roller 51Y by a magnetic field generated by the magnets. As the sleeve rotates, the developer G moves along a circumference of the developing roller 51Y.

The percentage (concentration) of toner in the developer G (ratio of toner to carrier) in the developing device 5Y is constantly adjusted within a predetermined range. More specifically, the toner supply device 60Y (see FIG. 3) supplies toner from the toner container 32Y to the developer-containing compartment 54Y as the toner in the developing device 5Y is consumed to maintain a constant concentration. The configuration and operation of the toner supply device 60Y are described in detail later.

The two conveying screws 55Y stir and mix the developer G with the toner added to the developer-containing compartment 54Y while circulating the developer G (toner) in the developer-containing compartments 53Y and 54Y. In this case, the developer G moves in the direction perpendicular to the surface of the paper on which FIG. 2 is drawn. The toner in developer G is triboelectrically charged by friction with the carrier and electrostatically attracted to the carrier. Then, the toner is carried on the developing roller 51Y together with the carrier by magnetic force generated on the developing roller 51Y.

The developer G carried on the developing roller 51Y is transported in the direction indicated by arrow A2 illustrated in FIG. 2 to the doctor blade 52Y. The amount of developer G on the developing roller 51Y is adjusted by the doctor blade 52Y, after which the developer G is transported to a development range opposite the photoconductor drum 1Y. The toner in the developer G is attracted to the electrostatic latent image formed on the photoconductor drum 1Y due to the effect of an electric field generated in the development range. As the sleeve rotates, the developer G remaining on the developing roller 51Y reaches an upper part of the developer-containing compartment 53Y and separates from the developing roller 51Y.

Next, the toner supply devices 60Y, 60M, 60C, and 60K are described below in detail with reference to FIGS. 3 and 4.

As illustrated in FIGS. 1 to 4, the respective color toners in the toner containers 32Y, 32M, 32C, and 32K installed in the toner container mount 70 are supplied to the corresponding developing devices 5Y, 5M, 5C, and 5K by the toner supply devices 60Y, 60M, 60C, and 60K provided for the respective color toners according to the amount of toner consumed in the corresponding developing devices 5Y, 5M, 5C, and 5K.

It is to be noted that the four toner supply devices 60Y, 60M, 60C, and 60K have a similar structure, and the four toner containers 32Y, 32M, 32C, and 32K have a similar structure except for the color of toner used in the image forming processes. Therefore, the toner supply device 60Y and the toner container 32Y for yellow are described below as representatives, and descriptions of the toner supply devices 60M, 60C, and 60K and the toner containers 32M, 32C, and 32K for the other three colors are omitted.

Figure 3:
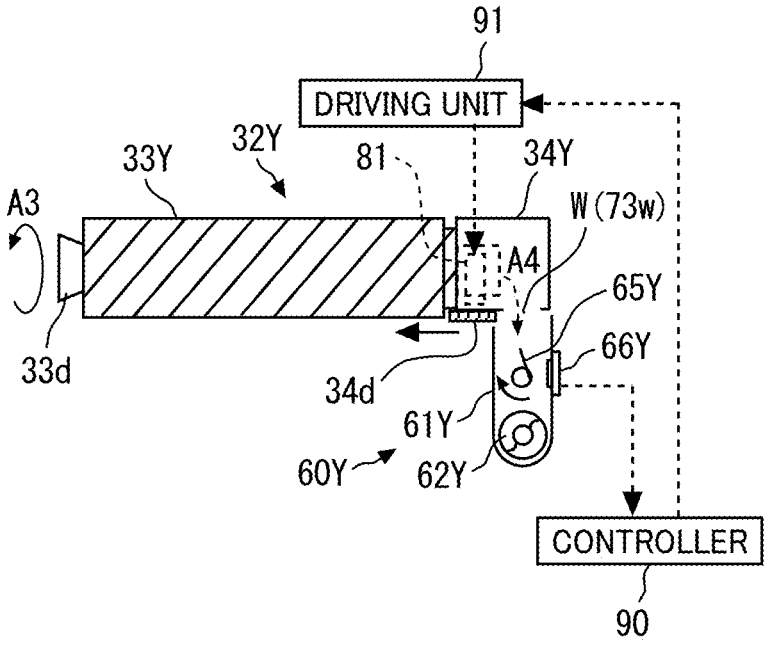
FIG. 3 is a schematic view of a toner supply device of the image forming apparatus in FIG. 1, in which a toner container is installed.
Figure 4:
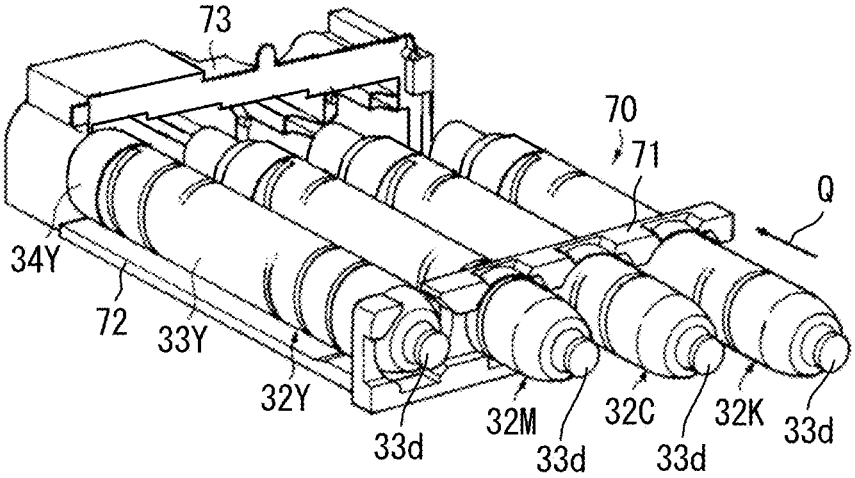
FIG. 4 is a perspective view of toner containers installed in a toner container mount of the image forming apparatus in FIG. 1.

When the toner container 32Y is installed in the toner container mount 70 of the image forming apparatus 100 in the direction indicated by arrow Q as illustrated in FIG. 4 (hereinafter, referred to as the "installation direction"), a shutter 34*d* (see FIG. 3) of the toner container 32Y is moved in conjunction with the installation of the toner container 32Y, and a toner outlet W (see FIG. 3) of the toner containers 32Y is opened. Consequently, the toner outlet W of the toner container 32Y communicates with a toner supply inlet 73*w* of the toner supply device 60Y. Accordingly, toner contained in the toner container 32Y is discharged from the toner outlet W, passes through the toner supply inlet 73*w*, and then, is stored in a toner tank 61Y of the toner supply device 60Y.

Figure 7:
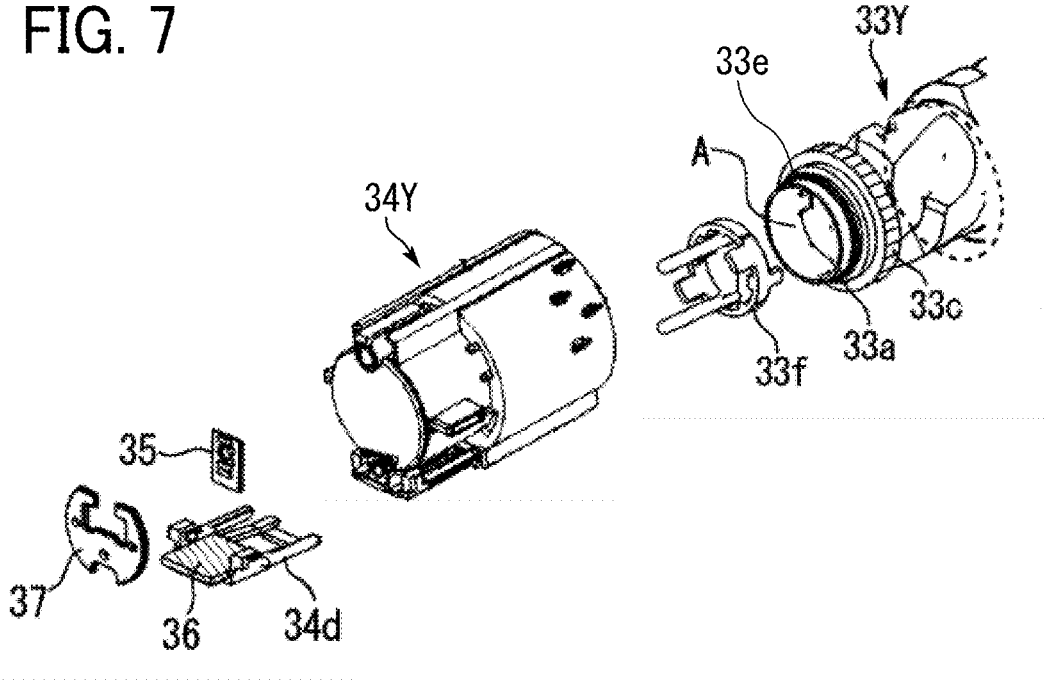
FIG. 7 is an exploded view of the toner container.

With reference to FIG. 3, it can be seen that the toner container 32Y is a substantially cylindrical toner bottle and includes a cap 34Y and a cylindrical container body (bottle body) 33Y formed together with a gear 33*c* (see FIG. 7). The cap 34Y is held by the toner container mount 70 so as not to rotate. The container body 33Y is held so as to rotate relative to the cap 34Y and driven to rotate by a driving unit 91 in the direction indicated by arrow A3 illustrated in FIG. 3. The driving unit 91 includes a driving motor, a drive gear 81, and the like. The container body 33Y includes a helical rib 33*b* (see FIG. 5) protruding inward from an inner circumferential face of the container body 33Y. As the container body 33Y rotates, the helical rib 33*b* transports toner in the toner container 32Y (the container body 33Y) in the longitudinal direction of the container body 33Y (from the left to the right in FIG. 3). As a result, the toner is discharged through the toner outlet W of the cap 34Y. That is, the driving unit 91 rotates the container body 33Y of the toner container 32Y as required, thereby supplying the toner to the toner tank 61Y. Note that the toner containers 32Y, 32M, 32C, and 32K are replaced with new ones when the respective service lives thereof have expired, that is, when almost all toner contained in the toner container 32 has been depleted.

With reference to FIG. 3, it can be seen that the toner supply device 60Y includes the toner container mount 70 (see FIG. 4), the toner tank 61Y, a toner conveying screw 62Y, a stirrer 65Y, a toner end sensor 66Y, and the driving unit 91.

The toner tank 61Y is disposed below the toner outlet W of the toner container 32Y to store toner discharged through the toner outlet W of the toner container 32Y. A bottom of the toner tank 61Y is coupled to an upstream side of the toner conveying screw 62Y in the direction in which the toner is transported.

The toner end sensor 66Y is disposed on a side wall of the toner tank 61Y at a predetermined height from the bottom and detects that the amount of toner stored in the toner tank 61Y has fallen below a predetermined amount. For example, a piezoelectric sensor can be used as the toner end sensor 66Y. When a controller 90 recognizes that the amount of toner stored in the toner tank 61Y is less than the predetermined amount using the toner end sensor 66Y, the controller 90 causes the driving unit 91 (including the drive gear 81) to rotate the container body 33Y of the toner container 32Y for a predetermined period, thereby supplying toner to the toner tank 61Y. If the toner end sensor 66Y continues to report "toner end" even when this operation is repeated for a predetermined number of times, the controller 90 recognizes that the toner container 32Y is empty (toner depletion). Then, the controller 90 causes a control panel of the image forming apparatus 100 to prompt a user to replace the toner container 32Y.

The stirrer 65Y is disposed at the center of the toner tank 61Y (near the toner end sensor 66Y) to prevent agglomeration of the toner stored in the toner tank 61Y. The stirrer 65Y includes a shaft and a flexible member disposed on the shaft. The stirrer 65Y rotates clockwise in FIG. 3 to stir the toner in the toner tank 61Y. The tip of the flexible member of the stirrer 65Y slidingly contacts a surface where the toner end sensor 66Y detects in rotation cycles. As a result, the toner does not adhere to the surface detected by the toner end sensor 66Y, thereby preventing the detection accuracy from deteriorating.

A toner conveying screw 62Y transports the toner stored in the toner tank 61Y obliquely upward. Specifically, the toner conveying screw 62Y transports the toner linearly from the bottom (the lowest point) of the toner tank 61Y to a point above the developing device 5Y. Then, the toner thus transported by the toner conveying screw 62Y falls through the downward toner passage 64Y (see FIG. 2) and is supplied to the developer-containing compartment 54Y in the developing device 5Y.

With reference to FIG. 4, it can be seen that the toner container mount 70 includes a cap holder 73 to hold the cap 34Y of the toner container 32Y, a bottle holder (container body holder) 72 to hold the container body 33Y of the toner container 32Y, and an insertion entrance 71 through which the toner container 32Y is installed.

With reference to FIG. 1, as a front cover of the image forming apparatus 100 (on the front side in the direction perpendicular to the surface of the paper on which FIG. 1 is drawn) is opened, the insertion entrance 71 of the toner container mount 70 is exposed. The toner containers 32Y, 32M, 32C, and 32K are installed and removed from the front side of the image forming apparatus 100, in the longitudinal direction of the toner containers 32Y, 32M, 32C, and 32K as the installation direction, with the longitudinal axis of the toner containers 32Y, 32M, 32C, and 32K kept horizontal.

Herein, the longitudinal length of the bottle holder 72 is almost equal to the longitudinal length of the container body 33Y. The cap holder 73 is located on one side in the longitudinal direction (installation direction) of the bottle holder 72. The insertion entrance 71 is located on the other, opposite side of the bottle holder 72 in the longitudinal direction (installation direction) of the bottle holder 72, that is, the side away from the cap holder 73. Accordingly, in the installation of the toner container 32Y into the toner container mount 70, the cap 34Y passes through the insertion entrance 71, slides on the bottle holder 72 over a certain distance, and is then attached to the cap holder 73.

Next, the toner containers 32Y, 32M, 32C, and 32K are described in detail with reference to FIGS. 5 to 12.

Figure 5:
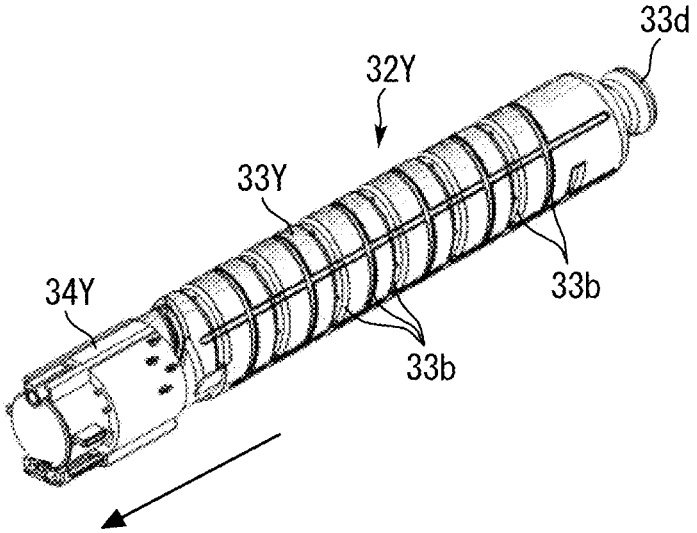
FIG. 5 is a perspective view of the toner container illustrated in FIG. 3 when viewed obliquely from above.
Figure 6:
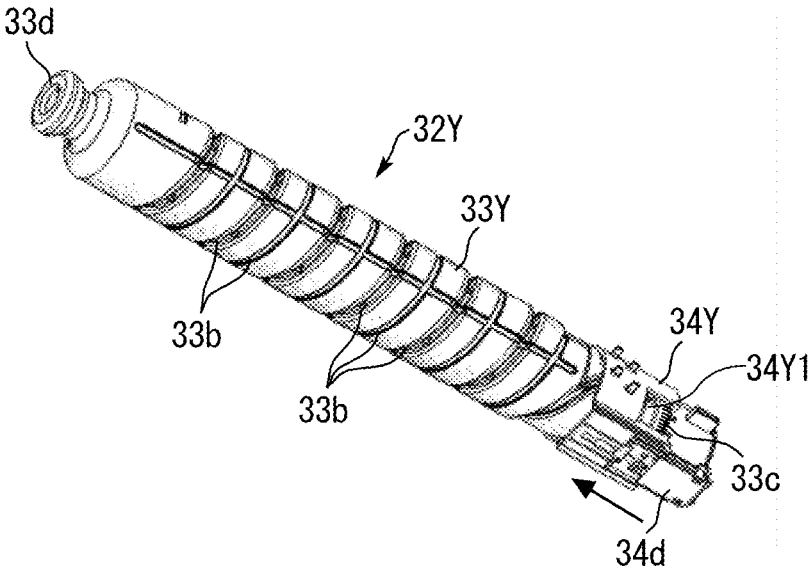
FIG. 6 is a perspective view of the toner container illustrated in FIG. 3 when viewed obliquely from below.
Figure 8:
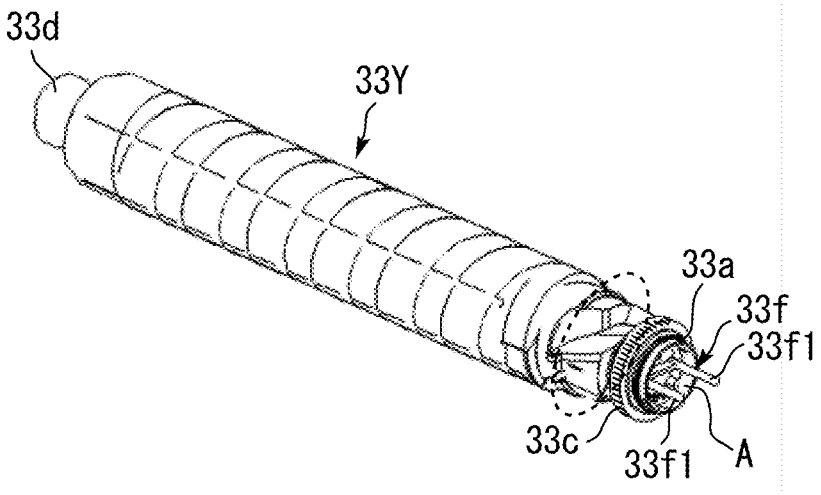
FIG. 8 is a perspective view of a container body of the toner container.

As illustrated in FIGS. 5 and 6, the toner container 32Y includes the cylindrical container body (bottle body) 33Y and the cap (bottle cap) 34Y into which the head of the container body 33Y is inserted. With reference to FIGS. 7 and 8, it can be seen that the toner container 32Y is disassembled into a stirring member 33*f*, the shutter 34*d*, a shutter seal 36, a radiofrequency identification (RFID) tag 35, a cover 37, and the like, in addition to the container body 33Y and the cap 34Y.

Figure 9:
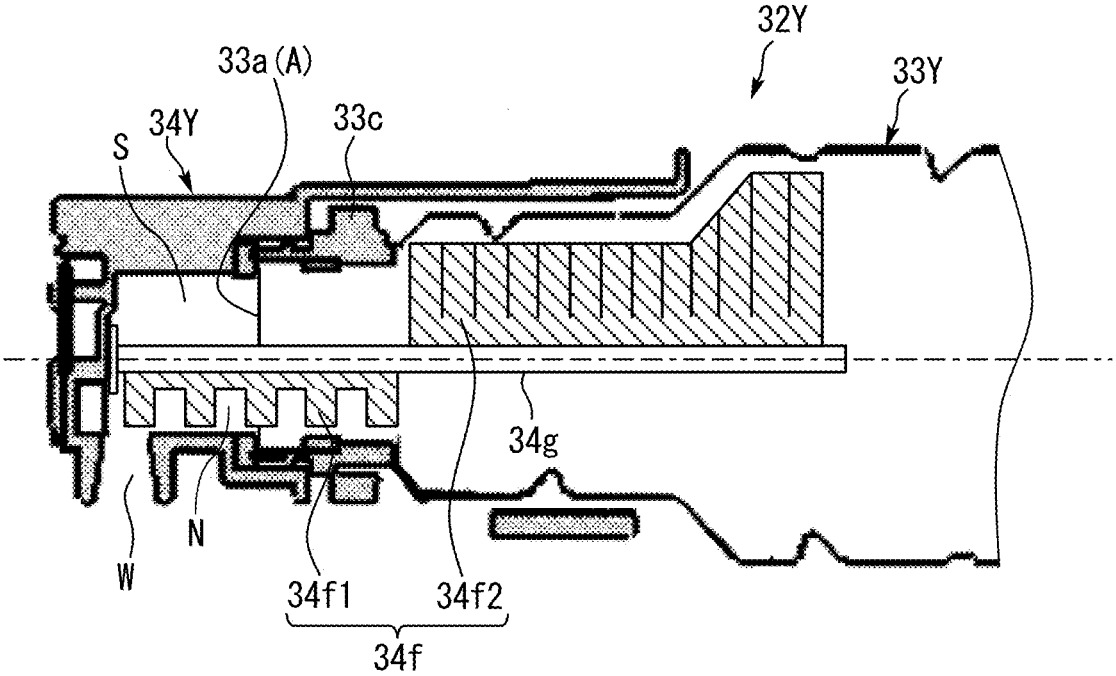
FIG. 9 is a cross-sectional view of a part of the toner container along an axial direction of rotation of the toner container.
Figure 10:
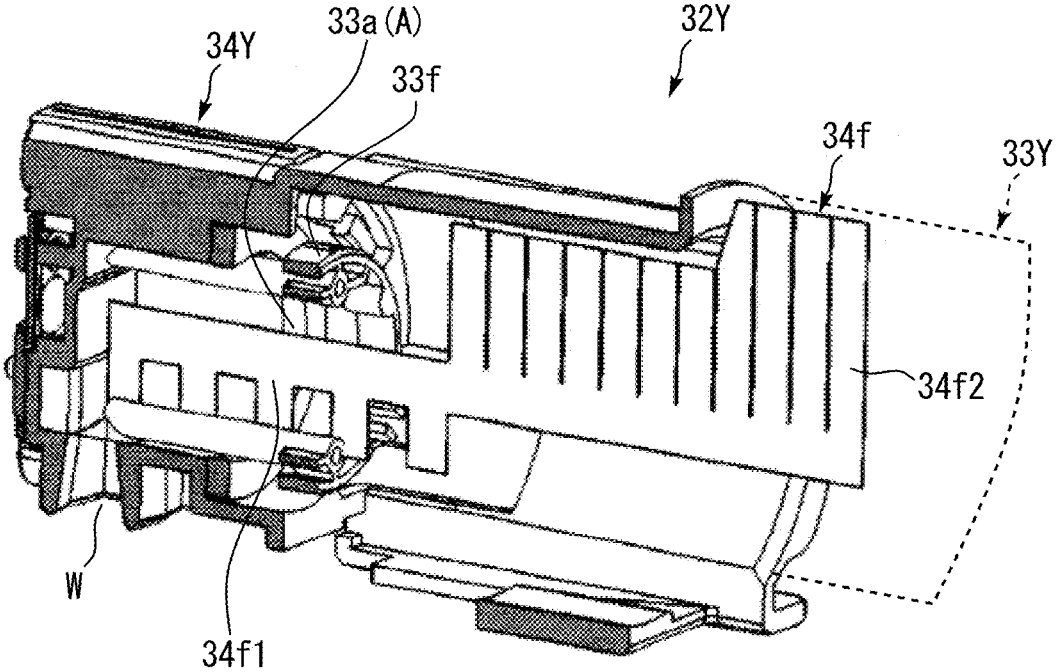
FIG. 10 is a perspective, cross-sectional view of a part of the toner container.

As illustrated in FIGS. 7 and 8, the gear 33*c*, which rotates together with the container body 33Y, and an opening A are disposed at the head on one side of the cylindrical container body 33Y in the longitudinal direction (horizontal direction in FIGS. 9 and 10). The opening A is disposed at the head of the container body 33Y, which is on a leading side when the toner container 32Y is installed in the toner container mount 70, and toner contained in the container body 33Y is discharged through the opening A to a hollow space S inside the cap 34Y as illustrated in FIG. 9.

The toner in the container body 33Y is transported to the hollow space S of the cap 34Y (i.e., the container body 33Y is driven to rotate) so that the amount of toner in the cap 34Y does not fall below a predetermined draft line (threshold).

The gear 33*c* meshes with the drive gear 81 provided in the toner container mount 70 of the image forming apparatus 100 to rotate the container body 33Y around a center of rotation indicated by the alternate long and short dash line in FIG. 9. An axis of rotation of the container body 33Y (hereinafter, referred to as the "rotation axis") extends in the longitudinal direction of the container body 33Y.

Specifically, the gear 33*c* surrounds the whole opening A, and a plurality of teeth radiates outward relative to the center of rotation of the container body 33Y. A part of the gear 33*c* is exposed from a cut-out portion 34Y1 (see FIG. 6) formed in the cap 34Y, and the gear 33*c* meshes with the drive gear 81 of the image forming apparatus 100 located obliquely below the gear 33*c*. The driving force is transmitted from the drive gear 81 to the gear 33*c*, and the container body 33Y rotates in the direction indicated by arrow A3 in FIG. 3. In the present embodiment, the drive gear 81 and the gear 33*c* are spur gears.

With reference to FIGS. 5 and 6, it can be seen that a grip 33*d* for users to grasp the toner container 32Y during installation and removal is provided on the other end of the container body 33Y (on the upstream or rear end in the installation direction). The user installs the toner container 32Y in the image forming apparatus 100 while grasping the grip 33*d*. When installed into the image forming apparatus 100, the toner container 32Y is moved in the direction indicated by the arrow in FIG. 5.

Additionally, the helical rib 33*b* protruding inward is formed on the inner circumferential face of the container body 33Y. In other words, a helical groove is formed on an outer circumferential face of the container body 33Y when viewed from outside. The helical rib 33*b* is for discharging toner contained in the container body 33Y through the opening A. As the container body 33Y rotates around the rotation axis extending in the longitudinal direction of the container body 33Y, the helical rib 33*b* transports the toner toward the opening A.

In the present embodiment, the container body 33Y is made of, for example, polyethylene terephthalate (PET). The container body 33Y can be produced together with the gear 33*c* and the grip 33*d* disposed on the outer circumferential face as a single piece by blow molding.

With reference to FIGS. 7 and 8, it can be seen that the toner container 32Y in the present embodiment includes the stirring member 33*f* that rotates together with the container body 33Y. The stirring member 33*f* fits into a bottle rim 33*a* (the opening A) of the container body 33Y.

The stirring member 33*f* is provided with a pair of substantially rod-shaped blades 33*f*1 that extends toward the hollow space S in the cap 34Y from the opening A of the container body 33Y. The two blades 33*f*1 are disposed opposite each other in the circumferential direction. The rotation of the stirring member 33*f* (the blades 33*f*1) together with the bottle rim 33*a* (the opening A) of the container body 33Y improves the ability to discharge toner from the opening A.

With reference to FIGS. 7 and 8, it can be seen that the bottle rim 33*a* of the container body 33Y has a pawl portion 33*e* (see FIG. 7) that is formed in a circumferential direction and engageable with the cap 34Y. With this configuration, the container body 33Y rotatably engages the cap 34Y. Therefore, the gear 33*c* rotates relative to the cap 34Y.

The inner diameter of the head of the container body 33Y near the gear 33*c* is smaller than the inner diameter of the portion to store toner, where the helical rib 33*b* is formed. The head of the container body 33Y includes a pump-up portion surrounded by the broken-line circles in FIGS. 7 and 8 that gradually protrudes inward from the inner circumferential face. The toner transported toward the opening A by the helical rib 33*b* along with rotation of the container body 33Y is pumped up by the pump-up portion surrounded by the broken-line circles in FIGS. 7 and 8 to the portion of the head having the small inner diameter. Thereafter, the toner pumped up to the portion of the head having the small inner diameter is discharged from the opening A to the hollow space S of the cap 34Y while being stirred by the stirring member 33*f*.

With reference to FIG. 7, it can be seen that the shutter 34*d*, the shutter seal 36, the RFID tag 35, and the cover 37 are attached to the cap 34Y of the toner container 32Y.

The bottle rim 33*a* (the opening A) of the container body 33Y is inserted into the cap 34Y. The toner outlet W is disposed at the bottom of the cap 34Y. Toner discharged from the opening A of the container body 33Y is discharged outside the toner container 32Y and falls vertically downward through the toner outlet W. The shutter 34*d* (see FIG. 6) is held and slidably movable at the bottom of the cap 34Y to open and close the toner outlet W. Specifically, the shutter 34*d* opens the toner outlet W by a relative movement in the longitudinal direction from the cap 34Y toward the container body 33Y (movement in the direction indicated by the arrow in FIG. 6). The shutter 34*d* closes the toner outlet W by a relative movement in the longitudinal direction from the container body 33Y toward the cap 34Y (movement in the direction opposite to the direction indicated by the arrow in FIG. 6). The shutter 34*d* moves to open and close the toner outlet W in conjunction with movement of the toner container 32Y that is installed in and removed from the toner container mount 70 of the image forming apparatus 100.

The cap 34Y having such a configuration communicates with the container body 33Y via the opening A, and the toner discharged from the opening A is discharged through the toner outlet W as indicated by broken-line arrow A4 illustrated in FIG. 3.

In the present embodiment, the substantially cylindrical hollow space S (see FIG. 9) extending in the longitudinal direction is formed inside the cap 34Y. In addition, in the cap 34Y, a columnar downward path, through which toner falls, having a predetermined cross-sectional area extends from a lower circumference of the substantially cylindrical hollow space S toward the toner outlet W. With this configuration, toner discharged from the opening A of the container body 33Y to the hollow space S of the cap 34Y falls through the columnar downward path and is smoothly discharged outside the toner container 32Y (to the toner tank 61Y) through the toner outlet W.

With reference to FIG. 7, an annular cap seal adheres to an inner face of the cap 34Y facing the bottle rim 33*a* surrounding the opening A of the container body 33Y. The cap seal seals the gap between the container body 33Y and the cap 34Y around the opening A, and is made of, for example in the present embodiment, an elastic material (foam resin material) such as foamed polyurethane.

The RFID tag 35 is provided on an end face of the cap 34Y, and the cover 37 covers the RFID tag 35. The RFID tag 35 stores data such as the production number of the toner container 32Y and the number of recycles, toner volume, lot number, and color. The data in the RFID tag 35 is written and read by the image forming apparatus 100.

The configuration and operation of the toner container 32Y, 32M, 32C, and 32K according to the present embodiment are described below.

As illustrates in FIGS. 9 and 10, a sheet member 34*f* is attached inside the cap 34Y of the toner container 32Y.

In the present embodiment, the sheet member 34*f* is made of a flexible material such as a plastic sheet having a thickness of about 0.01 to 0.15 mm. The sheet member 34*f* includes a first elastic-deformation portion 34*f*1 located near the toner outlet W and a second elastic-deformation portion 34*f*2 located in the container body 33Y and near the opening A. The first and second elastic-deformation portions 34*f*1 and 34*f*2 are elastically deformable.

Specifically, the sheet member 34*f* is supported by a stationary shaft 34*g* extending in the direction of rotation axis (longitudinal direction) of the container body 33Y. The root of the stationary shaft 34*g* is firmly secured to the face of the cap 34Y facing the opening A of the container body 33Y so that the tip of the stationary shaft 34*g* enters the interior of the container body 33Y. In the present embodiment, the sheet member 34*f* is sandwiched and secured between the milling surface of the stationary shaft 34*g* and a plate by screwing or the like.

However, the manner to secure the sheet member 34*f* is not limited to the above-described embodiments, but various types of configurations can be used.

The first elastic-deformation portion 34*f*1 has a plurality of teeth arranged in a comb shape in the longitudinal direction of the container body 33Y, facing the toner outlet W (the downward path). In particular, the plurality of teeth of the first elastic-deformation portion 34*f*1 are arranged in a row with a gap in the longitudinal direction. That is, the teeth of the first elastic-deformation portion 34*f*1 face downward, and the gap (concave notch) N is provided between the adjacent teeth.

On the other hand, the second elastic-deformation portion 34*f*2 has a plurality of teeth arranged in a comb shape in the longitudinal direction, contacting an upper portion of the inner wall (inner circumferential face) of the container body 33Y. In particular, the plurality of teeth of the second elastic-deformation portion 34*f*2 is arranged in a row without a gap in the longitudinal direction. That is, the teeth of the second elastic-deformation portion 34*f*2 face upward and are provided with cuts such that the adjacent teeth contact each other.

Even when the container body 33Y is driven to rotate during toner supply in the image forming apparatus 100 (the toner supply device 60Y), the sheet member 34*f* is supported in a non-rotating state by the toner supply device 60Y together with the cap 34Y.

Figure 11:
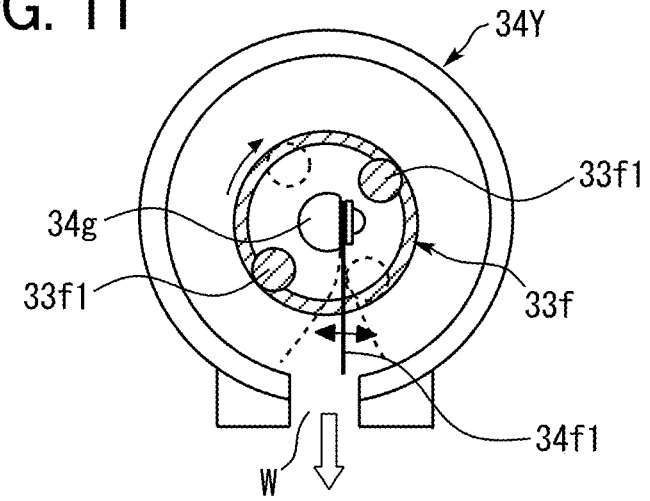
FIG. 11 is a cross-sectional view of a cap of the toner container at a toner outlet of the cap.

With reference to FIG. 11, it can be seen that, as the container body 33Y (the stirring member 33*f*) rotates clockwise as indicated by the arrow in FIG. 11, the first elastic-deformation portion 34*f*1 strikes the stirring member 33*f* fitted into the opening A (the bottle rim 33*a*) of the container body 33Y, thereby repeating deformation in rotation cycle.

Specifically, the first elastic-deformation portion 34*f*1 is provided so as to be able to interfere with the blade 33*f*1 of the stirring member 33*f* and is disposed directly above the toner outlet W. The blades 33*f*1 of the stirring member 33*f* rotate to the position indicated by the broken-line circles in FIG. 11 and interfere with the first elastic-deformation portion 34*f*1, causing the first elastic-deformation portion 34*f*1 to bend leftward. After that, as the stirring member 33*f* further rotates and the interference of the blade 33*f*1 with the first elastic-deformation portion 34*f*1 is released, the elasticity of the first elastic-deformation portion 34*f*1 urges the first elastic-deformation portion 34*f*1 rightward so that the first elastic-deformation portion 34*f*1 is flipped to the right, and eventually returns to the original position illustrated by the solid line. By repeating such swinging of the first elastic-deformation portion 34*f*1 as indicated by the double-headed arrow in FIG. 11, toner near (above) the toner outlet W is constantly stirred and loosened, thereby preventing the toner from agglomerating and clogging the opening.

In particular, in the present embodiment, the plurality of teeth in the first elastic-deformation portion 34*f*1 are arranged in a row with the gap in the longitudinal direction, thereby facilitating flow of toner at the bottom of the hollow space S in the cap 34Y as compared with the case in which the teeth are arranged in a row without the gap.

In the present embodiment, the first elastic-deformation portion 34*f*1 strikes the stirring member 33*f* to repeat the elastic deformation. Alternatively, the first elastic-deformation portion 34*f*1 can directly strike the container body 33Y (e.g., a projection disposed on the bottle rim 33*a*) to repeat the elastic deformation.

Figure 12:
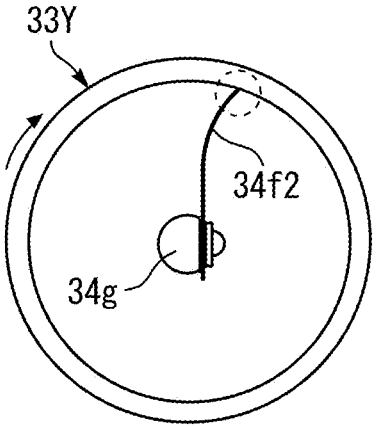
FIG. 12 is a cross-sectional view of the container body near an opening of the container body.

On the other hand, with reference to FIG. 12, it can be seen that the second elastic-deformation portion 34*f*2 slidingly contacts the upper portion of the inner wall near the opening A of the container body 33Y along with rotation of the container body 33Y in the direction indicated by the arrow in FIG. 12.

Specifically, the second elastic-deformation portion 34*f*2 has a length sufficient to slidingly contact the upper portion of the inner circumferential face near the opening A surrounded by the broken-line circle in FIG. 12. As the container body 33Y rotates, the edge of the second elastic-deformation portion 34*f*2 slidingly contacts the upper portion of the inner wall of the container body 33Y. The upper portion of the inner wall is constantly replaced with the surface in a different place of the inner wall along with rotation of the container body 33Y. At that time, due to the elasticity of the second elastic-deformation portion 34*f*2, the second elastic-deformation portion 34*f*2 maintains the deformed shape illustrated in FIG. 12 or vibrates, thereby scraping off toner adhering to the inner wall at the upper portion. Toner is likely to accumulate near the opening A from top to bottom. In particular, the toner is likely to adhere to the upper portion of the inner wall. If the toner adheres to the inner wall, the amount of toner remaining in the toner container 32Y increases at the time of toner depletion. Further, if the toner that has agglomerated after adhering to the inner wall is separated from the inner wall and enters the toner outlet W, the toner outlet W may be blocked by the agglomerated toner. In the present embodiment, since the toner adhering to the upper portion of the inner wall is constantly scraped off by the second elastic-deformation portion 34*f*2, such problems as described above hardly occur.

In particular, in the present embodiment, the plurality of teeth in the second elastic-deformation portion 34*f*2 are arranged in a row without a gap in the longitudinal direction. As a result, toner adhering to the periphery of the helical rib 33*b* on the inner wall can be scraped off cleanly as compared with the case in which the plurality of teeth in the second elastic-deformation portion 34*f*2 are arranged in a row with a gap.

As described above, in the present embodiment, the sheet member 34*f* including the first and second elastic-deformation portions 34*f*1 and 34*f*2 loosens toner near the toner outlet W and scraps off toner adhering to the inner wall in the container body 33Y and near the opening A, thereby preventing the toner outlet W from being blocked by the agglomerated toner. Therefore, toner can be satisfactorily discharged from the toner container 32Y, and the defective toner supply to the developing device 5Y is less likely to occur.

As described above, the toner container 32Y includes the container body 33Y having the opening A disposed at the head of the container body 33Y, the cap 34Y into which the head of the container body 33Y is inserted, and the sheet member 34*f* attached inside the cap 34Y. The container body 33Y is cylindrical and rotates around the rotation axis extending in the longitudinal direction of the container body 33Y to transport toner contained in the container body 33Y toward the opening A. The cap 34Y has the toner outlet W through which the toner discharged from the opening A is discharged outside the toner container 32Y. The sheet member 34*f* include the first elastic-deformation portion 34*f*1 that is elastically deformable and located near the toner outlet W, and the second elastic-deformation portion 34*f*2 that is elastically deformable and located in the container body 33Y and near the opening A.

This configuration prevents the toner outlet W from being blocked by agglomerated toner.

As a result, according to the present disclosure, a toner container, a toner supply device, and an image forming apparatus can be provided that prevent the agglomerated toner from blocking the toner outlet.

It is to be noted that, although the toner containers 32Y, 32M, 32C, and 32K contain only toner in the above-described embodiments, alternatively, toner containers may contain a two-component developer including toner and carrier to be used in image forming apparatuses in which the two-component developer is supplied to the developing device.

In such configurations, effects similar to those described above are also attained.

Further, in the present embodiment, a part or all of the image forming units 6Y, 6M, 6C, and 6K may be a process cartridge. In such configurations, effects similar to those described above are also attained.

It is to be noted that the term "process cartridge" used in the present disclosure means a removable unit including an image bearer and at least one of a charging device to charge the image bearer, a developing device to develop latent images on the image bearer, and a cleaning device to clean the image bearer that are united together, and is designed to be removably installed as a united part in the image forming apparatus.

The above-described embodiments are illustrative and do not limit the present disclosure. Thus, numerous additional modifications and variations are possible in light of the above teachings. It is therefore to be understood that within the scope of the present disclosure, the present disclosure may be practiced otherwise than as specifically described herein. The number, position, and shape of the components described above are not limited to those embodiments described above. Desirable number, position, and shape can be determined to perform the present disclosure.

What is claimed is:

1. A toner container comprising:

a cylindrical container body having a head with an opening in the head and configured to rotate around a rotation axis extending in a longitudinal direction of the cylindrical container body to transport toner contained in the cylindrical container body toward the opening;

a cap into which the head of the cylindrical container body is inserted, having a toner outlet through which the toner discharged from the opening is discharged outside the toner container, the toner outlet being at a bottom portion of the cap when the toner container is at a mounted oriented, a rotation of the cylindrical container body causes the toner to move toward the toner outlet;

a stationary shaft extending along the rotation axis, the stationary shaft at an inner part of the cap; and a sheet member, supported by the stationary shaft, the sheet member including:

a first elastic-deformation portion that is elastically deformable, located within the cap and above the toner outlet when the toner container is at a mounted orientation, wherein the toner drops due to gravity and exits from the toner outlet due to gravity; and a second elastic-deformation portion that is elastically deformable, located in the cylindrical container body.

2. The toner container according to claim 1, wherein the first elastic-deformation portion has a plurality of teeth arranged in a comb shape in the longitudinal direction, at least one of the plurality of teeth facing the toner outlet, and wherein the second elastic-deformation portion has a plurality of teeth arranged in a comb shape in the longitudinal direction, and the plurality of teeth of the second elastic-deformation portion contacts an upper portion of an inner wall of the cylindrical container body.

3. The toner container according to claim 2, wherein a gap is secured between adjacent teeth of the plurality of teeth of the first elastic-deformation portion, and wherein the plurality of teeth of the second elastic-deformation portion is arranged in a row without a gap in the longitudinal direction.

4. The toner container according to claim 2, further comprising a stirring member attached to the cylindrical container body, wherein the first elastic-deformation portion is configured to strike the cylindrical container body or the stirring member as the cylindrical container body rotates to exhibit repeated elastic deformation.

5. A toner supply device comprising the toner container according to claim 1, wherein the toner container is removably installable in the toner supply device, and wherein the toner supply device is configured to supply toner from the toner container to a developing device.

6. An image forming apparatus comprising the toner container according to claim 1.

7. The toner container according to claim 1, further comprising:

a shutter slidably mounted to the bottom portion of the cap to slidably cover and uncover the toner outlet, the shutter including a planar portion to cover the toner outlet.

8. The toner container according to claim 7, wherein the shutter comprises:

a planar portion to cover the toner outlet, the planar portion having a horizontal orientation when the toner container is at the mounted orientation.

9. A toner container comprising:

a cylindrical container body having a head with an opening in the head and configured to rotate around a rotation axis extending in a longitudinal direction of the cylindrical container body to transport toner contained in the cylindrical container body toward the opening;

a cap into which the head of the cylindrical container body is inserted, having a toner outlet through which the toner discharged from the opening is discharged outside the toner container; and a sheet member attached inside the cap, the sheet member including:

a first elastic-deformation portion that is elastically deformable, located near the toner outlet; and a second elastic-deformation portion that is elastically deformable, located in the cylindrical container body and near the opening, the toner container further comprising a stationary shaft extending along the rotation axis, the stationary shaft supporting the sheet member, wherein the first elastic-deformation portion has a plurality of teeth arranged in a comb shape in the longitudinal direction, the plurality of teeth facing the toner outlet, and wherein the second elastic-deformation portion has a plurality of teeth arranged in a comb shape in the longitudinal direction, and the plurality of teeth of the first elastic-deformation portion contacts an upper portion of an inner wall of the cylindrical container body.

10. The toner container according to claim 9, wherein a gap is secured between adjacent teeth of the plurality of teeth of the first elastic-deformation portion, and wherein the plurality of teeth of the second elastic-deformation portion is arranged in a row without a gap in the longitudinal direction.

11. The toner container according to claim 9, further comprising a stirring member attached to the cylindrical container body, wherein the first elastic-deformation portion is configured to strike the cylindrical container body or the stirring member as the cylindrical container body rotates to exhibit repeated elastic deformation, and wherein the second elastic-deformation portion is configured to slidingly contact the upper portion of the inner wall of the cylindrical container body along with rotation of the cylindrical container body.

12. The toner container according to claim 2, wherein:

the second elastic-deformation portion is configured to slidingly contact the upper portion of the inner wall of the cylindrical container body along with rotation of the cylindrical container body.

13. A toner container, comprising:

a cylindrical container body having a head with an opening in the head and to rotate around a rotation axis extending in a longitudinal direction of the cylindrical container body to transport toner contained in the cylindrical container body toward the opening;

a cap with the head of the cylindrical container body therein, the cap including a toner outlet through which the toner discharged from the opening is discharged outside the toner container, the toner outlet being at a bottom portion of the cap when the toner container is at a mounted oriented; and a sheet attached inside the cap, the sheet including:

a first elastic-deformation portion that is elastically deformable, located within the cap and above the toner outlet, when the toner container is at a mounted orientation, where the toner drops out due to gravity; and a stationary shaft extending along the rotation axis, the stationary shaft supporting the sheet, wherein the first elastic-deformation portion has a plurality of teeth arranged in a comb shape in the longitudinal direction, at least one of the plurality of teeth facing the toner outlet; and a stirrer attached to the cylindrical container body, wherein the first elastic-deformation portion strikes the cylindrical container body or the stirrer as the cylindrical container body rotates and repeatedly elastically deforms.

* * * * *